United States Patent [19]

Morgan

[11] 4,136,990

[45] Jan. 30, 1979

[54] HIGHWAY MARKER

[76] Inventor: Alan W. Morgan, 328 Ferndale, Rochester, Mich. 48063

[21] Appl. No.: 910,447

[22] Filed: May 30, 1978

[51] Int. Cl.[2] ..... E01F 9/00

[52] U.S. Cl. ..... 404/9; 404/16; 350/97

[58] Field of Search ..... 404/9, 16, 15, 14, 13, 404/12, 11; 40/125 A, 125 N; 350/97, 67

[56] References Cited

U.S. PATENT DOCUMENTS

| | | | |
|---|---|---|---|
| 1,298,840 | 4/1919 | Wertz | 350/97 |
| 1,377,161 | 5/1921 | Vanderbeek | 350/97 |
| 1,821,052 | 9/1931 | Davies | 404/16 |
| 1,981,206 | 11/1934 | Strauss | 404/16 X |
| 2,329,171 | 9/1943 | Russ | 404/9 |
| 2,489,499 | 11/1949 | Pezlar | 404/16 |
| 3,332,327 | 7/1967 | Heenan | 404/16 |
| 3,458,245 | 7/1969 | Stanley | 350/67 |

*Primary Examiner*—Nile C. Byers, Jr.
*Attorney, Agent, or Firm*—Cullen, Sloman, Cantor, Grauer, Scott & Rutherford

[57] ABSTRACT

A highway marker comprises a metallic body of rectangular shape adapted for nesting and enclosure within a recess formed in a roadway. Said body has upright side and end walls and a flat bottom wall and with opposed downwardly and inwardly inclined inner side walls and downwardly and inwardly inclined inner end walls. A transverse rib of A-shape extends between said inner side walls intermediate their ends and has a pair of oppositely arranged downwardly and inwardly inclined side walls, all said inclined walls extending to and merging with said bottom wall. A reflectorized layer is applied to each inclined wall. A layer of adhesive material is applied to the bottom and side walls adapted for securing the marker within a roadway recess so as to be flush with the top surface of said roadway.

10 Claims, 3 Drawing Figures

HIGHWAY MARKER

BACKGROUND OF THE DISCLOSURE

Heretofore various types of roadway markers have been provided upon the outer margins of a roadway and/or the median thereof. Examples of roadway markers may be found in the following U.S. Pat. Nos.: 3,094,046, 3,901,684, 3,396,639, 3,604,781, 3,458,245, and 1,298,840.

These prior art efforts to provided roadway markers and including markers applied to the side of the roadway, over the top of the roadway, recessed in the roadway and with some mechanism for providing for light reflection.

SUMMARY OF THE INVENTION

It is the object of the present invention to provide an improved and simplified and less costly roadway marker which is nested down into longitudinally spaced recesses along roadway margins or along the median thereof and wherein the roadway marker has formed therein a series of inclined inner side and end walls including a transverse ridge with inclined walls and with reflectorized surfaces upon the inclined walls to reflect light from the oncoming lights of a vehicle.

There is another advantage provided in the improved highway marker. A unit construction adapted for snug nesting and securing down within a recess within the highway and to provide a plurality of inclined reflectorized surfaces adapted to respond to the lights of an oncoming vehicle.

These and other objects will be seen from the following specification and claims in conjunction with the appended drawing.

THE DRAWING

It is understood that the above drawing illustrates merely a preferred embodiment of the invention, and that other embodiments are contemplated within the scope of the claims hereinafter set forth.

DETAILED DESCRIPTION OF THE INVENTION

Figure 1:
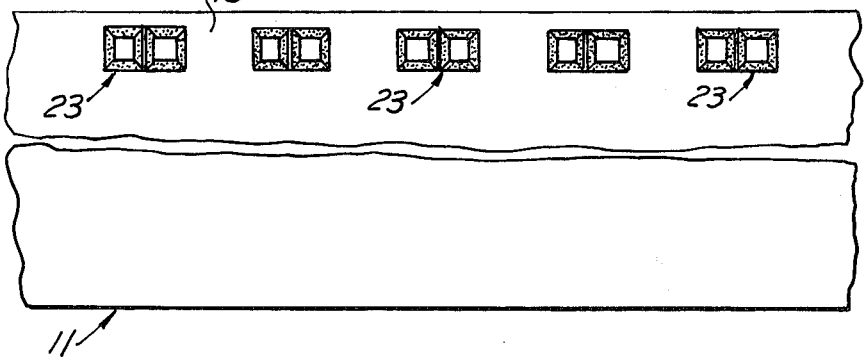
FIG. 1 is a schematic fragmentary view of a roadway showing a series of the present reflectorized markers applied thereto.

Referring to the drawing, FIG. 1 is a fragmentary showing of a portion of a roadway 11 having a top surface 13 and nested down into said top surface and recessed therein a series of longitudinally spaced aligned markers 23.

Figure 3:
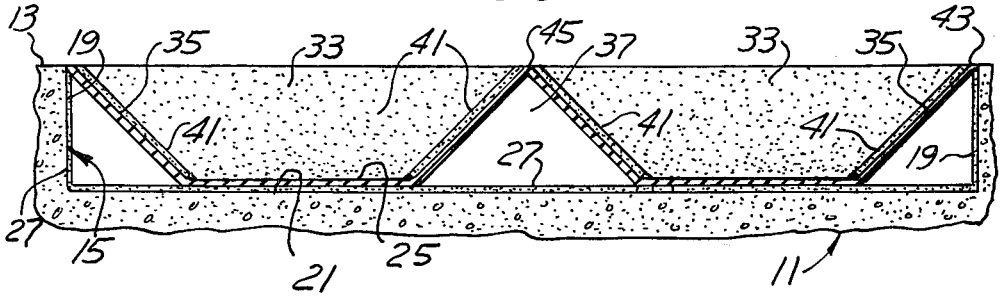
FIG. 3 is a framentary section taken in the direction of arrows 3—3 of FIG. 2.
Figure 2:
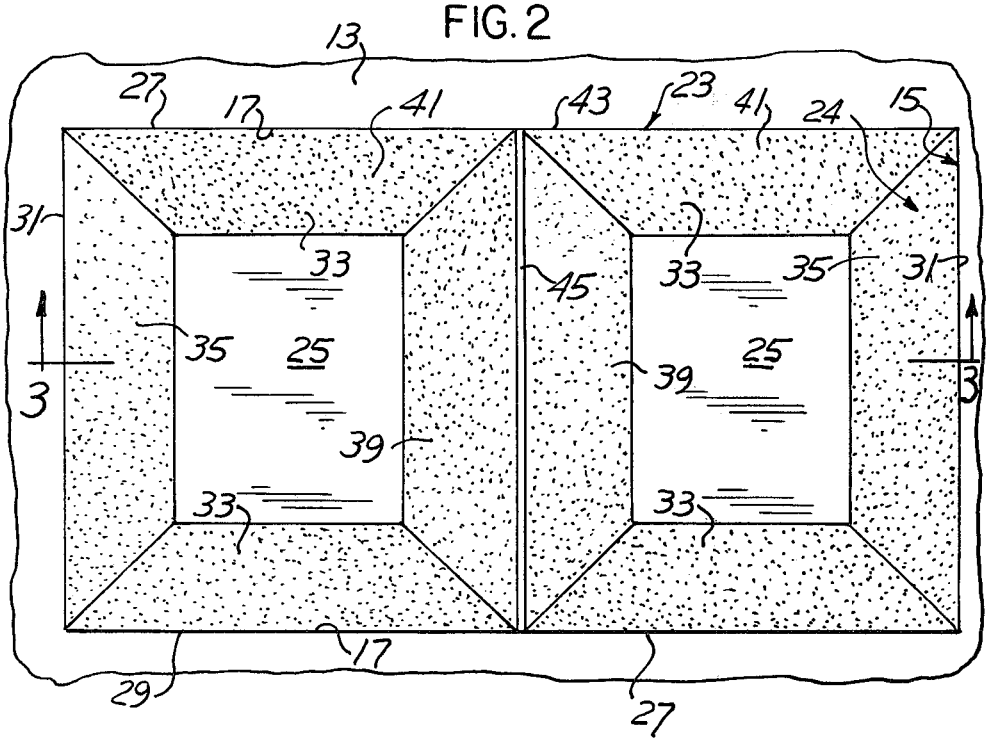
FIG. 2 is a plan view of the present marker, on an enlarged scale fragmentarily showing a portion of the roadway and the recess therein for said marker.

As best shown in FIGS. 2 and 3, there is formed down into the surface of the roadway a series of longitudinally spaced recesses or cavities 15 having upright side walls 17, upright end walls 19, and a flat bottom wall 21.

The present reflectorized marker includes an elongated rectangular metallic body 23 of unit construction. Said body could be of plastic material as an equivalent construction.

The marker body includes an elongated rectangular bottom wall 25. A layer of adhesive material 27, made of an epoxy resin or other suitable cement, is applied to the undersurface of said bottom wall and to the side and end walls of the body and is adapted for cooperative securing registry with the bottom wall 21 and side and end walls 17,19 of the roadway recess for anchoring the marker 23 therein.

The marker body includes the opposed upright outer side walls 29 and the opposed outer upright end walls 31 of such construction and dimension as to be snugly disposed in use down into the respective recess 15 formed within said highway so that the top surface of the marker body is flush with road surface 13.

The marker includes opposed downwardly and inwardly inclined inner side walls 33 which extend to and merge with bottom wall 25. Also, said body includes opposed downwardly and inwardly inclined inner end walls 35 along the width of said body which extend to and merge with said bottom wall.

The marker body also includes as a part thereof a transverse ridge 37 of A-shape extending between said inner side walls intermediate their ends and including a pair of downwardly and inwardly inclined side walls 39 which extend to and merge with bottom wall 25. In certain applications, additional transverse ridges may be incorporated.

Each of the inclined surfaces 33, 35 and 39 are rendered reflective by the application thereto of a reflectorized layer 41, FIG. 3.

The reflectorized areas may be a plastic reflector with a smooth outer surface and a multi-faceted undersurface similar to reflectors on bicycles, and automobiles, or presently used on elevated highway markers. Examples may be found in any of the patents listed on page one herein.

The reflectorized marker includes around its periphery a continuous marginal edge 43 and the coplanar top edge 45 of ridge 37.

As shown in FIG. 3, the top edges 43 and 45 are also coplanar with the road surface 13 and flush therewith so that the present marker is nested down into the highway recess.

The angle of the respective inclined surfaces 33, 35 and 39 is in the range of 30° to 60° so as to receive and reflect the headlights from an oncoming vehicle to thereby designate either the margin or median of the roadway pavement 11, or to caution the driver, depending on its color.

Since the marker is recessed down into the highway and does not form an obstruction, it should have a long life regardless of the traffic passing thereover of at least two to four years. Snowplows will not harm the recessed markers.

Cleaning of markers will be achieved by passage of vehicle tires over the markers, said tires exerting a vacuum action so that self-cleaning will occur. Dust, dirt, water and snow will be largely removed.

Various types of roadway devices may be employed which are adapted to pass over the corresponding markers in a continuous line for cleaning the top surface thereof from time to time.

In the illustrative embodiment, it is contemplated that the depth of the roadway recess by approximately 3/4 of an inch corresponding to the vertical height of the marker body 24. In the preferred embodiment, the marker is four inches wide and eight inches long. This corresponds to the width of the usual paint stripes.

The markers are not only visible, but the physical vibration of a vehicle when passing over a series of the markers adds to lane identification as in foggy weather and also should the driver go to sleep. A modified marker can omit the central ridge 39 and be of a size 4 inches × 4 inches. This decreases the cost in volume use. In most of the open highway situations, the smaller marker would be effective.

Having described my invention, reference should now be had to the following claims.

I claim:

1. A highway marker comprising a metallic or plastic body of rectangular shape adapted for nesting within a recess formed in a roadway;

said body having upright side and end walls and a flat bottom wall;

opposed downwardly and inwardly inclined inner side walls along the length of said body extending to and merging with said bottom wall;

opposed downwardly and inwardly inclined inner end walls along the width of said body extending to and merging with said bottom wall;

and a reflectorized layer upon each of said inclined walls, said marker providing a visual guide, and readily noticable vibrations to aid in lane identification.

2. In the marker of claim 1, a transverse rib of A-shape extending between said inner side walls intermediate their ends and having a pair of downwardly and outwardly inclined side walls extending to and merging with said bottom wall; and a reflectorized layer upon said latter inclined walls.

3. In the marker of claim 2, said body, ridge, side and end walls being formed as a unit.

4. In the marker of claim 2, a layer of adhesive material upon the undersurface of said bottom wall, and upon said side and end walls.

5. In the marker of claim 2, said side and end walls being triangular in cross-section.

6. In the marker of claim 2, the top peripheral edges of said side and end walls and said ridge being coplanar.

7. In combination with the highway marker of claim 2, a roadway having a top surface having along at least one edge a series aligned longitudinally spaced recesses therein below its top surface;

and a series of said markers snugly nested down into each of said recesses, with the top of said marker bodies flush with the roadway top surface, said reflectorized surfaces adapted to reflect a line of light from the headlights of the vehicle on said highway.

8. In the combination of claim 7, a layer of adhesive material upon the undersurface of said marker bottom wall and its side and end walls adapted for securing registry with said roadway.

9. In the combination of claim 7, each recess having opposed upright side and end walls, the corresponding outer side and end walls of said marker body snugly engaging said recess walls and fully enclosed thereby.

10. In the marker of claim 2, said reflectorized layer including a smooth outer surface and an internal multi-faceted undersurface of color selected from the group: green, amber, and red.

* * * * *